US005600347A

United States Patent [19]

Thompson et al.

[11] Patent Number: 5,600,347

[45] Date of Patent: Feb. 4, 1997

[54] HORIZONTAL IMAGE EXPANSION SYSTEM FOR FLAT PANEL DISPLAYS

[75] Inventors: Stephen P. Thompson, Delray Beach, Fla.; Masaki Oie; Akihiro Ogura, both of Sagamihara, Japan; Kiyoshi Takemura, Tokyo, Japan; Joseph D. Harwood, Boca Raton, Fla.

[73] Assignee: International Business Machines Corporation, Armonk, N.Y.

[21] Appl. No.: 177,628

[22] Filed: Dec. 30, 1993

[51] Int. Cl.[6] ..... G09G 5/00

[52] U.S. Cl. ..... 345/127; 345/132

[58] Field of Search ..... 345/1, 2, 3, 127, 345/128, 129, 130, 131, 132, 138; 358/451; 348/790, 800, 801, 448, 458

[56] References Cited

U.S. PATENT DOCUMENTS

| | | | |
|---|---|---|---|
| 4,675,830 | 6/1987 | Hawkins | 345/128 |
| 4,891,702 | 1/1990 | Nakayama | 358/451 |
| 5,016,000 | 5/1991 | Bugg | 345/130 |
| 5,335,295 | 8/1994 | Ferracini et al. | 358/451 |

FOREIGN PATENT DOCUMENTS

| | | | |
|---|---|---|---|
| 0038757 | 3/1980 | Japan | 358/451 |
| 0231970 | 12/1984 | Japan | 358/451 |
| 2144294 | 2/1985 | United Kingdom | 358/451 |

*Primary Examiner*—Richard Hjerpe
*Assistant Examiner*—Kara Farnandez Stoll
*Attorney, Agent, or Firm*—David L. McCombs

[57] ABSTRACT

A system for horizontal expansion of low resolution display modes onto high resolution displays including flat panels at a variable scaling factor is disclosed. The system may be combined with known methods for vertical expansion to allow low resolution display modes to be expanded onto any high resolution display. Two different methods are provided, one for graphics modes and one for text modes, to attain better screen image quality. In the first method, a first pixel data sequence to be expanded is first oversampled at a multiple of the frequency thereof to produce an intermediate oversampled data sequence. The oversampled data sequence is linearly decimated by a factor of less than unity to produce a replicated second data sequence longer than the first, which is then displayed. In the second method, the intermediate oversampled data sequence is filtered to provide an interpolated oversampled data sequence, which is then decimated instead of the intermediate oversampled data sequence, to further improve the screen image quality. No particular mechanism for the graphics controller or display logic is required, eliminating complicated image processing and enabling the size, complexity and cost of the video subsystem of a computer to be reduced.

21 Claims, 4 Drawing Sheets

100
104
SYSTEM MEMORY
CPU
BUS CONTROLLER
GRAPHICS CONTROLLER
DRAM
FLAT PANEL DISPLAY
110
112
102
106
108

108
200
HOST INTERFACE
CRTC
HORIZONTAL EXPANSION LOGIC
202
208
DIGITAL
FLAT PANEL DISPLAY
112
MEMORY
FIFO
204
206
DRAM
110

202
208
300
CONTROLLER CHIP
DATA
A
306
F/F
B
308
DECIMATION m/2n
C
112
FLAT PANEL
F/2
304
CLOCK 2
F
CLOCK
302

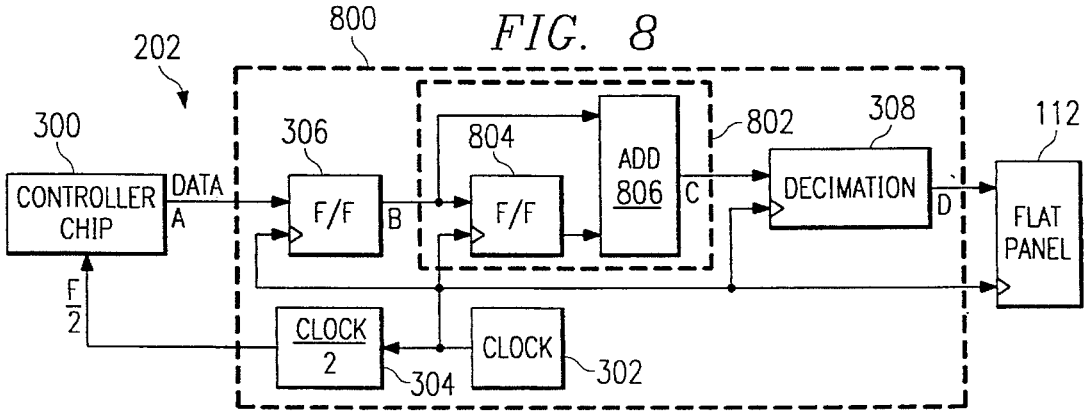
FIG. 8
800
202
300
CONTROLLER CHIP
DATA
A
306
F/F
B
804
F/F
ADD 806
C
802
308
DECIMATION
D
112
FLAT PANEL
F/2
CLOCK 2
304
CLOCK
302

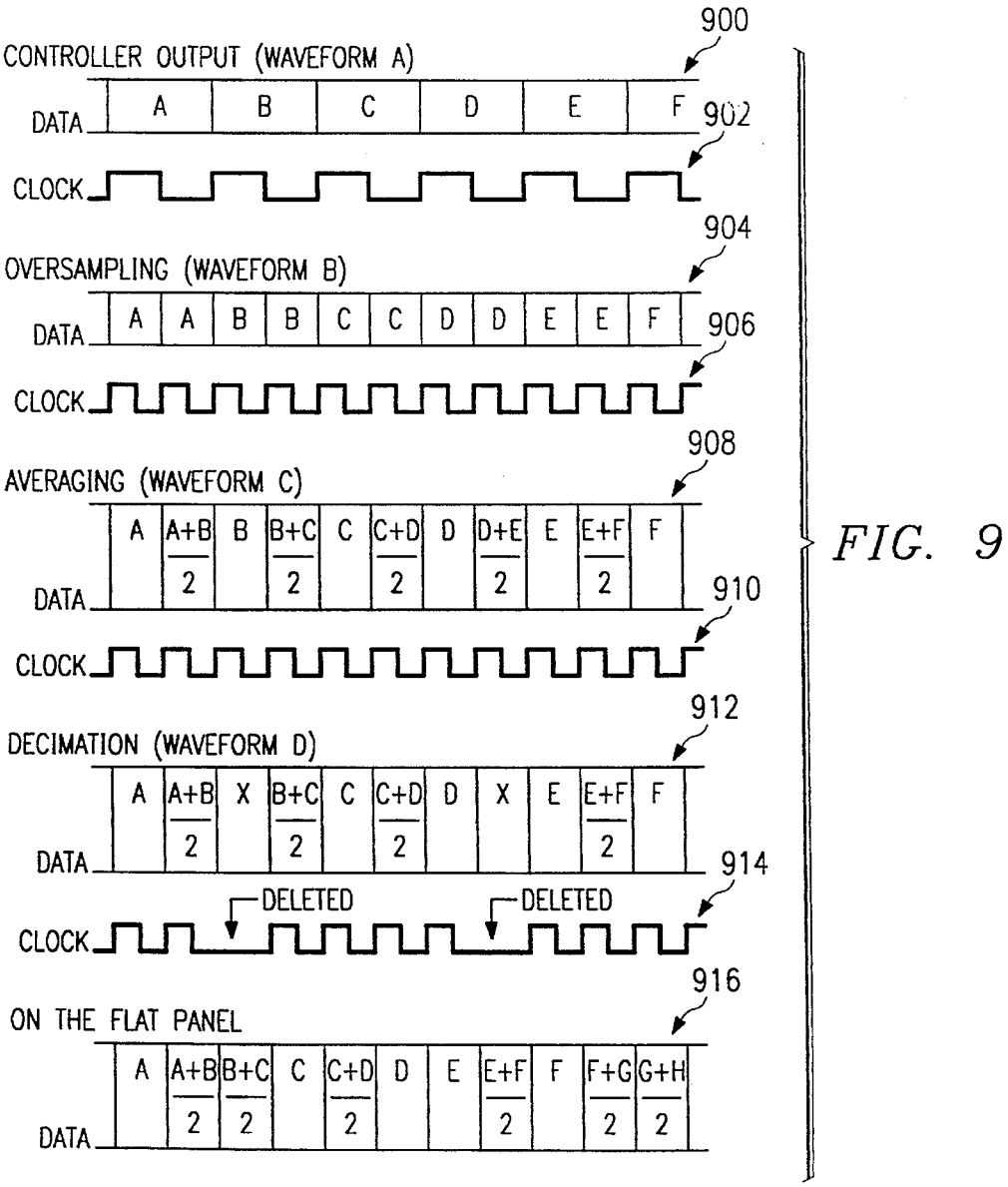
900
CONTROLLER OUTPUT (WAVEFORM A)
DATA
A B C D E F
902
CLOCK
904
OVERSAMPLING (WAVEFORM B)
DATA
A A B B C C D D E E F
906
CLOCK
908
AVERAGING (WAVEFORM C)
DATA
A A+B/2 B B+C/2 C C+D/2 D D+E/2 E E+F/2 F
910
CLOCK
912
DECIMATION (WAVEFORM D)
DATA
A A+B/2 X B+C/2 C C+D/2 D X E E+F/2 F
914
DELETED
DELETED
CLOCK
916
ON THE FLAT PANEL
DATA
A A+B/2 B+C/2 C C+D/2 D E E+F/2 F F+G/2 G+H/2
FIG. 9

HORIZONTAL IMAGE EXPANSION SYSTEM FOR FLAT PANEL DISPLAYS

TECHNICAL FIELD

This invention relates to a system for horizontal image expansion primarily in the context of flat panel displays having a fixed number of display pixels per horizontal scan line, unlike analog displays, such as cathode ray tubes (CRTs).

BACKGROUND OF THE INVENTION

In conventional flat panel display technology, a low resolution image can be displayed upon a higher resolution screen by limiting the display to a portion of the screen having the same resolution as the image, or by expanding the image by replication of pixels horizontally or vertically or both. Typically, vertical lines may be added by periodically replicating the pixels of the preceding line to provide the desired expansion factor.

However, horizontal expansion of character data is not provided because the character clock is typically used to clock the display, this being a submultiple of the pixel clock rate. Thus, the aspect ratio of text screens may be distorted by the vertical expansion without a corresponding horizontal expansion.

Image expansion is a traditional problem in video image processing. Many systems exist for applications such as image display and printing, but typically the methods employed are complicated and cannot be performed in real time, usually requiring large amounts of memory, and therefore cannot be considered suitable for a low cost panel display video subsystem.

Without expansion, for example, a VGA 640×480 pixel screen output would be displayed in a reduced area on a 1024×768 SVGA flat panel display, which would defeat the purpose of the higher resolution screen. This type of display method would leave 384 pixels blank at the right of the screen and 288 blank lines at the bottom of the page. To increase the usable screen area, both horizontal and vertical expansion, preferably by the correct scale factor, are required. To expand a 640×350 EGA display to a VGA display would require vertical expansion from 350 lines to 480 lines, which could be achieved by replication of 130 of the 350 original lines.

Many controller chips support such vertical expansion methods. However, none support a similar horizontal expansion method, as they are typically clocked at ⅛ of the pixel rate in VGA architecture. Eight pixels at a time are transmitted to the screen to provide the elements of one row of specific text character in text modes, or graphic information in graphics display modes. This results in a distorted aspect ratio such as with 640×480 images expanded to 640×768 pixels by replication of 288 lines.

Another approach in flat panel technology is to replicate pixels vertically using the panel logic to simultaneously activate two row drivers at selected times. The column drivers are usually split into several chips and all of them must be driven simultaneously during one line scan, making it impossible to replicate pixels horizontally.

What is needed is an efficient system to permit horizontal expansion of an image on a flat panel display by a variable scaling factor.

SUMMARY OF THE INVENTION

The foregoing problems are solved and a technical advance is achieved by a system for performing variable scale horizontal expansion of a first sequence of data elements to a second longer sequence of data elements for higher resolution display, in which the first data sequence is oversampled at a multiple of the frequency thereof, and then linearly decimated by a factor of less than unity to produce the second data sequence.

In one embodiment, the variable scale horizontal expansion is performed with a scaling factor (m/n). Horizontal expansion of a first sequence of data elements by a factor of two is performed, followed by horizontal compression by a factor of (m/2n). For example, a 640 pixel line may be expanded to 1024 pixels by first replicating every pixel to derive 1280 pixels, and then decimating the result by deleting (2n–m) pixels out of every 2n pixels.

A controller chip is coupled to a horizontal expansion logic of the present invention. The expansion logic includes a flip-flop register for receiving a first data sequence at a first clock frequency, a divider for generating a second clock frequency which is a multiple of the first clock frequency, a horizontal pattern register for generating from the first data sequence an intermediate oversampled data sequence at the frequency of the second clock signal, and a decimator for decimating the intermediate oversampled data sequence to produce a second, longer sequence of data signals which may then be displayed.

In operation with a typical computer graphics subsystem, the controller chip runs with its pixel clock rate divided by 2 and its output oversampled by a factor of 2. Then, selected pixel clock signals are deleted by the decimator logic. Although there are discontinuities in the pixel clock rate, the output pixels are compressed into the flat panel display because the data are first clocked into the display and then latched for a whole line period while the next line is assembled. Any screen compression ratio between 1 and 2 may thus be achieved by deleting the appropriate number of pixel clocks. Expansion by factors of more than 2 may also be achieved by increasing the oversampling ratio prior to decimation. When combined with the methods for vertical expansion, this system may be used for any degree of expansion, to any size of flat panel display, from a lower resolution image.

Two different methods are provided, one for graphics modes and one for text modes, to attain better screen image quality. In the first method, a first pixel data sequence to be expanded is first oversampled at a multiple of the frequency thereof to produce an intermediate oversampled data sequence. The oversampled data sequence is linearly decimated by a factor of less than unity to produce a replicated second data sequence longer than the first, which is then displayed. In the second method, the intermediate oversampled data sequence is filtered to provide an interpolated, oversampled data sequence, which is then decimated instead of the intermediate oversampled data sequence, to further improve the screen image quality.

A technical advantage achieved with the invention is that it performs such variable scale expansion in real time so that VGA software can run on a high resolution SVGA screen, for example.

Another technical advantage achieved is the performance of expansion without employing large amounts of memory, to reduce cost.

Another technical advantage achieved is that no particular graphics controller or display logic is required for a computer system employing the horizontal expansion logic of the invention. The system eliminates the need for complicated image processing, thereby reducing the size, complexity and cost of the video subsystem while still providing a high quality screen image.

BRIEF DESCRIPTION OF THE DRAWINGS

FIG. 8 is a block schematic of the functional components of another embodiment of a graphics controller of the invention, embodying interpolation circuitry; and FIG. 9 is a representation of typical waveforms occurring at various locations in the schematic of FIG. 8.

DESCRIPTION OF THE ILLUSTRATIVE EMBODIMENTS

Figure 1:
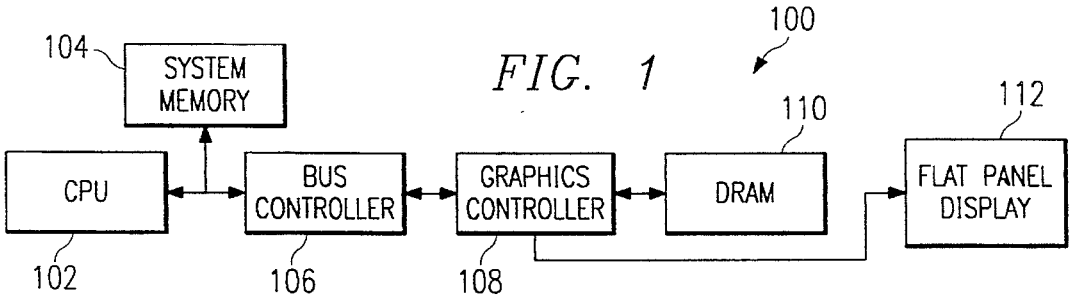
FIG. 1 is a block schematic of a computer system incorporating the invention.

FIG. 1 illustrates a computer system 100 employing features of the present invention for performing variable scale horizontal expansion for flat panel displays. The system 100 includes a central processing unit (CPU) 102 which operates with access to a system memory 104 and a bus controller 106. The bus controller 106 operates various peripherals (not shown) including a graphics controller 108 with its own DRAM (dynamic random access memory) 110. The graphics controller 108 in turn displays information on a flat panel display 112. The graphics controller 108 itself comprises several components, as will be detailed with reference to FIG. 2.

Figure 2:
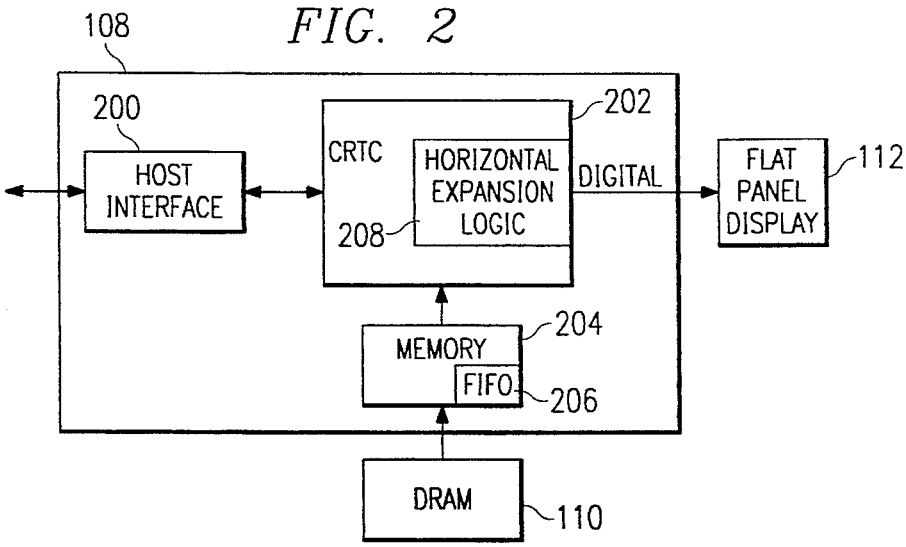
FIG. 2 is a block schematic of the graphics controller subsystem of FIG. 1.

In FIG. 2, the graphics controller 108 is shown in greater detail to illustrate the manner in which it drives the display 112. A host interface 200 communicates, via the bus controller 106 of FIG. 1, with the CPU 102, and with the system memory 104 to receive information to be displayed. A cathode ray tube controller (CRTC) 202 ordinarily provides the information to a typical cathode ray tube (CRT) (not shown) which may, for example, be a VGA display having a resolution of 640 pixels horizontally by 480 pixels vertically. The CRTC 202 may also include a capability for repeating a line of data to perform vertical expansion of the image to fit a flat panel display 112 having more than 480 rows of pixels. The CRTC 202 stores and retrieves data into its local cache memory 204 through a first-in, first-out (FIFO) buffer 206 to or from the DRAM 110.

According to the invention, horizontal expansion logic 208 is incorporated as part of the CRTC 202 so that graphics may be displayed on a flat panel display, such as the display 112, having more than 640 columns of pixels.

Figure 3:
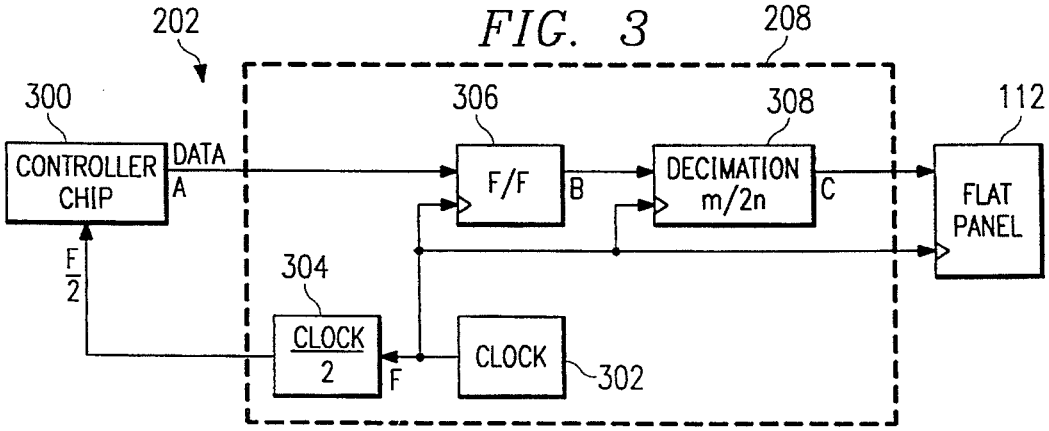
FIG. 3 is a block schematic of the functional components of the present invention embodied in the graphics controller of FIG. 2.

In FIG. 3 the CRTC 202 is shown in greater detail, including a controller chip 300 connected to components of the horizontal expansion logic 208. Various data registers and other components comprise elements of the controller chip 300 and the horizontal expansion logic 208, which will be understood by those skilled in the art in conjunction with this disclosure. The horizontal expansion logic 208 comprises a clock 302, a frequency divider 304, a flip-flop 306, and a decimator 308. The horizontal expansion logic 208 drives the flat panel display 112.

Figure 4:
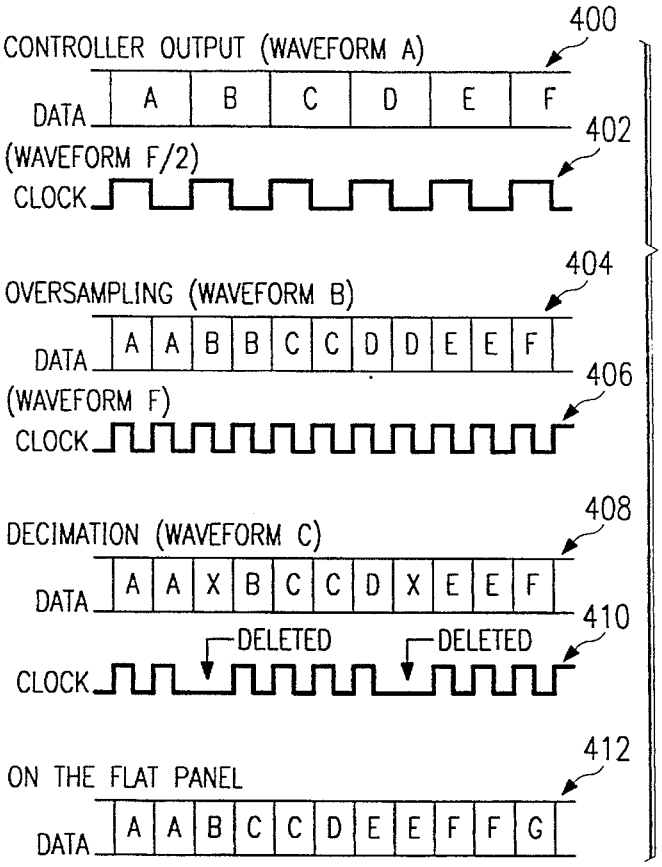
FIG. 4 is a representation of waveforms occurring in the schematic of FIG. 3.

FIG. 4 illustrates the operation of the horizontal expansion logic 208 with respect to waveforms occurring at critical points in the block schematic of FIG. 3. The clock 302 generates a clock waveform F at double the clock frequency required by the controller chip 300, and the frequency divider 304, typically a flip-flop, halves this to F/2. Meanwhile, data supplied to the controller chip 300 representing pixel information is clocked out of the chip at this rate, to provide the waveform 400 (waveform A) of FIG. 4, labeled DATA, at point A in FIG. 3. The waveform 402 (waveform F/2), labeled CLOCK, represents the signal output from the divider 304 at point F/2 in FIG. 3, the data being changed at the leading edges of this waveform. The data is fed to flip-flop 306, which is clocked at the double frequency rate F by the clock 302. The output of flip-flop 306 at point B in FIG. 3 is shown in FIG. 4 as a waveform 404, labeled OVERSAMPLING (waveform B), and immediately below this is a clock waveform 406 (waveform F) having a frequency F. Again, the data at point B (FIG. 3) changes at the leading edge of the clock waveform 406 (waveform F).

Next, the clock 302 signals and data signals, represented by waveforms 406 and 404, respectively (FIG. 4), are fed to the decimator 308. At this point, the number of data elements in a line of data has been doubled, but not all of these data elements need to be clocked into the display 112. For example, if there were originally 640 elements in the line, at point B there are 1280 data elements at the doubled rate. If the number of pixels in the display 112 is 1024, then one out of every five pixels need not be displayed, contracting the displayed data by one fifth. The decimator 308 performs this function, by selectively deleting every fifth clock pulse in this case, and thereby eliminating one out of every five data elements. This is shown by waveforms 408 (waveform C) and 410 in FIG. 4, where waveform C of FIG. 4 shows the letter X in place of data (B, D, etc.) of waveform B above. This data X never appears on the flat panel display 112. Instead, the data present only at the four active clocks out of five are transmitted into the flat panel display 112.

Thus the original data sequence ABCDEF . . . (waveform 400) at the controller chip 300 output (point A) is first oversampled to yield the data stream AABBCCDDEEF . . . (waveform 404) at the doubled rate, and then decimated to the stream AABCCDEEFFG . . . , as shown by the waveform 412. Thus, a new data line comprising 1024 elements has been created, yielding a horizontal expansion factor of 8/5 or 1.6 times. Combined with the capability of the controller chip 300 for repeating, for example, three out of each five horizontal lines, an image of 640×480 pixels resolution may be expanded to fit a screen displaying 1024×768 pixels.

The above logic employs Bresenham's line algorithm, and because it linearly decimates the doubled data stream, it is mostly useful for displaying graphics rather than text. A second method, discussed further below, has been devised for nonlinear decimation, based on the character cell, and is primarily useful for text display.

Figure 5:
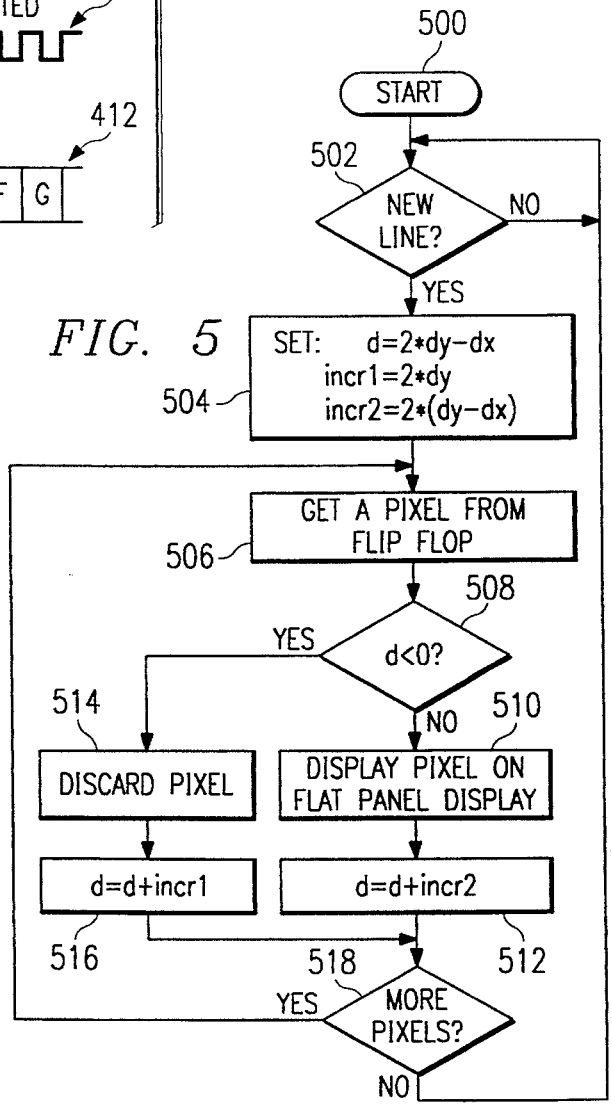
FIG. 5 is a flow diagram illustrating the method employed by the expansion logic of FIG. 2 for displaying a single line of expanded data.

FIG. 5 is a flowchart illustrating the method for performing horizontal expansion discussed above, using Bresenham's algorithm. After initializing the display 112 the method begins at step 500. At step 502, a decision is made to determine if a new horizontal display line is to be started. If so, execution proceeds to step 504 and otherwise continues in a closed loop. In step 504, several parameters are set. The value dy is the number of pixels per line of the oversampled data, typically twice the number of columns output by the graphics controller chip 108. The value dx is the number of pixels in each row of the graphics display. Parameters set up based on these values include the error term "d." At the beginning of a line, the error term d is set to 2dy−dx, or twice the number of output (line) pixels minus the number of input (row) pixels. The first increment variable incur1 is set to 2dy, twice the number of output pixels. The second increment variable incur2 is set to 2(dy−dx) or twice the difference between the number of output pixels and input pixels (this is a negative number).

In step 506, data for one pixel is retrieved from the flip-flop 306 at the input clock rate F (waveform 406). In step 508, the error term d is tested for a negative value. If d is non-negative, in step 510 the pixel is transferred to the display 112, automatically updating the horizontal coordinate. In step 512 the error term d is incremented by the second increment variable, incur2, which is negative, thereby reducing its value so that eventually the error term d will become negative, execution proceeds to step 518, discussed below. If in step 508 the value of the error term is negative, execution proceeds to step 514 where the pixel is discarded. In step 516, the error term d is incremented by the first increment variable incur1, and execution proceeds to step 518.

In step 518, a test is made for any more pixels in the current line of data. If none are present, execution returns to step 502 and the process is repeated. If more pixels are present in the current line, execution returns to step 506 where the next pixel is retrieved and processed as above.

The logic just described is an adaptation of Bresenham's line algorithm, which may be written concisely in Pascal, for example:

```
procedure BRESENHAM (x1, y1, x2, y2: integer);
    var dx, dy, incr1, incr2, d, x, y, xend:
    integer;
begin
    dx := x2 − x1;
    dy := y2 − y1;
    d := 2 dy − dx;
    incr1 := 2 dy;
    incr2 := 2 (dy − dx);
    x :=x1;
    y :=y1;
    xend := x2;
    WRITE_PIXEL(x,y);
    while x < xend do
    begin
        x := x + 1;
        if d < 0 then
            d := d + incr1
        else
        begin
            y := y + 1;
            d := d + incr2
        end; [of else condition statements]
```

-continued

```
WRITE_PIXEL(x,y);
    end [ while ]
end [ BRESENHAM ]
```

In the above method, WRITE_PIXEL(x,y) is a procedure which reads in the data for pixel number x from the input data stream and writes it to the graphics screen of the display 112 at horizontal location y. In a more typical use of Bresenham's algorithm, (x1,y1) and (x2,y2) would be coordinates of the end points of a line; (x,y) would be the coordinates of a point on the line; and WRITE_PIXEL(x,y) would be a procedure to write a pixel at the location (x,y). Typically, the pixels that are deleted are really first written and then overwritten with the new value; if the second WRITE_PIXEL(x,y) statement were inside the begin . . . end of the else statement, the write would only occur when the else statements were executed, not otherwise. If the incrementing of variable y were done externally by WRITE_PIXEL(x,y), the alternative construction would have to be used, otherwise it does not matter, as the effect is the same.

Figure 6:
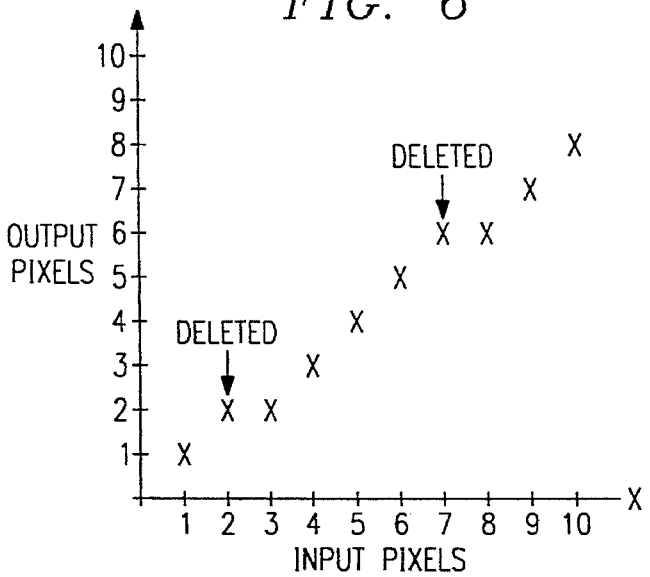
FIG. 6 is a graph illustrating the reduction of oversampled pixels by selectively deleting some of the input pixels to obtain fewer output pixels, according to the method of FIG. 5.

FIG. 6 shows the effect of executing the above algorithm for the first ten input pixels. Each "X" represents the x and y coordinates at the time of execution of a WRITE_PIXEL(x,y) statement. Thus, the first "X" represents reading the information for pixel 1 of the input data stream and writing it to pixel 1 of the output to the flat panel display 112. Similarly, pixel 2 of the input data stream is written to pixel 2 of the flat panel display 112 but then is deleted by overwriting it with pixel 3 of the input data stream. Another case is when pixel 7 is deleted by overwriting it with pixel 8 of the input data.

Figure 7:
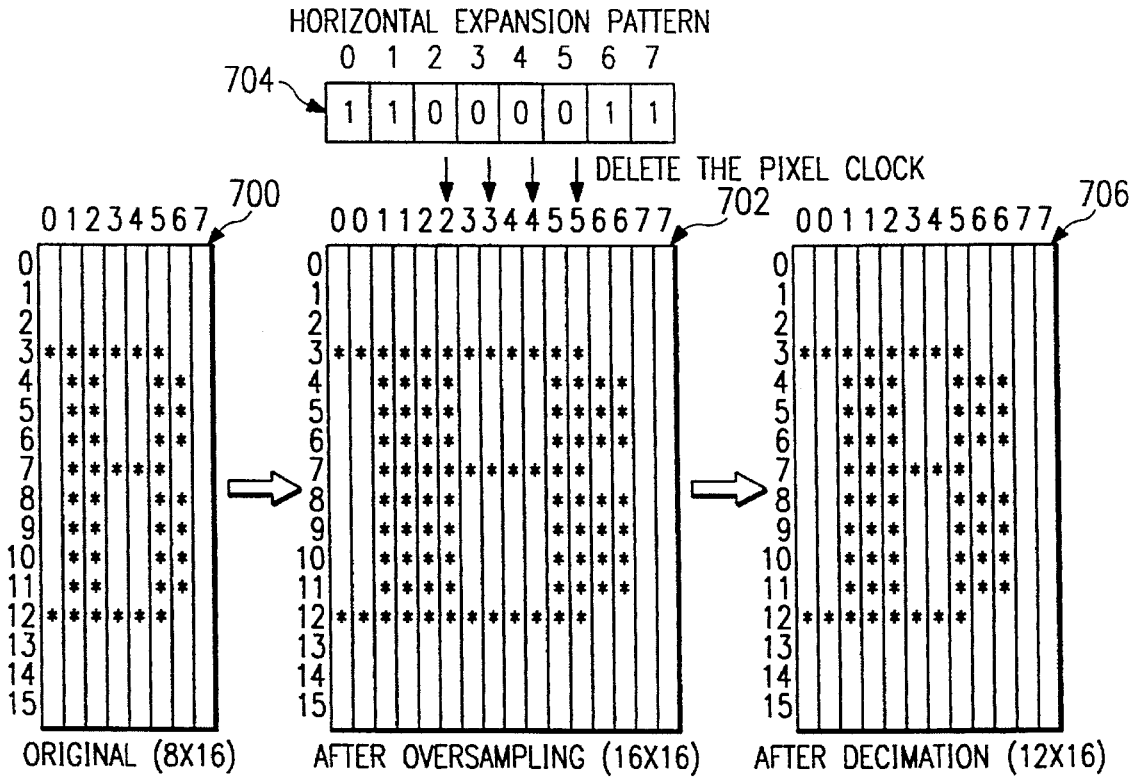
FIG. 7 is a schematic representation of a display showing the effect of the oversampling and decimation method of the invention as applied to a character cell, for use in a text display mode.

FIG. 7 illustrates the horizontal expansion method applied to a character cell. A typical character cell 700 on a VGA display screen is eight pixels wide by 16 pixels high. In order to display it onto an SVGA screen, an expansion ratio of 1.5 is chosen, so that the width becomes 12 pixels. The data in the cell is first oversampled to create a cell 702 which is 62 sixteen pixels wide. The data is then decimated in a nonlinear manner using a horizontal expansion pattern byte 704, in which each zero bit represents a deleted pixel clock and each 1 bit represents a replicated pixel of the original character cell 700. The result is a 12-pixel wide character cell 706.

The horizontal expansion pattern byte may be different for each character to be displayed and considerable improvement in image quality can be obtained by this method, as against linear expansion of each character cell over the whole screen.

The expanded image, assuming no vertical expansion in the controller chip 300 in text mode, covers an area of 960×480 pixels in the case of expansion by a factor of 1.5 from a VGA display controller, for example.

In FIG. 8, the CRTC 202 is shown in greater detail, including a controller chip 300 of the CRTC 202 connected to components of improved horizontal expansion logic 800 representing a modification of the logic 208 detailed in FIG. 3. The logic 800 utilizes one-dimensional interpolation instead of replication. The interpolation is provided by the use of a digital filter 802 after the flip-flop 306, comprising an extra flip-flop 804 and an adder 806. In a color system such an adder and flip-flop would be required for each of the RGB signals.

The output of the adder 806 is effectively scaled to become the average of two consecutive pixels rather than one pixel being either replicated or not. Naturally, this system is superior when used with an analog or grey scale capable display.

FIG. 9 shows the typical waveforms occurring at various points in the circuit of FIG. 8. The top four waveforms 900–906 are of course similar to those shown in FIG. 4. The output of the second flip-flop 804 is similar to waveform B, but delayed by one clock period, so that at point C after the adder 806, the resultant waveform is the averaged waveform 908 shown in FIG. 9. This is also clocked by the clock frequency F shown by the waveform 910 derived from clock 302.

After this averaging process, decimation occurs in exactly the same way as shown in FIG. 4, resulting in the decimation waveform 912 (waveform D) wherein "X" has been substituted in the locations where the pixel clock is to be deleted. The pixel clock showing the deleted clock pulses is shown as waveform 914 in FIG. 9. The resulting waveform 916 drives the flat panel display 112.

In each of the embodiments described above, the invention is characterized by a first step of oversampling, followed by an optional averaging step, and then the oversampled waveform is decimated to provide the correct number of pixels. If the scaling factor is m/n, where m >n >m/2, then the initial oversampling can be by a factor of 2. Following this, the image is compressed by a factor of m/2n which is less than 1. If the image expansion is to be larger than a 2:1 ratio, therefore, the initial oversampling can be by a larger factor than 2, so that the compression factor used in the decimation process can still be less than 1.

It is understood that the present invention can take many forms and embodiments. The embodiments shown herein are intended to illustrate rather than to limit the invention, it being appreciated that variations may be made without departing from the spirit or the scope of the invention. For example, although only one-dimensional interpolation has been shown, more complex filters can be used if desired, to improve the image quality still further when applied to color LCD panels. In addition, interpolation between adjacent lines to provide vertical expansion may also be performed when the controller is capable of such interpolation and a suitable amount of memory for storage of one line of data is available.

Although illustrative embodiments of the invention have been shown and described, a wide range of modification, change and substitution is intended in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. Apparatus for horizontal expansion of a first sequence of data elements representing pixels of graphics display lines to a second longer sequence of data elements for display on a graphics display panel of higher horizontal resolution than that of said first data sequence, the apparatus comprising:

an input register for receiving said first data sequence at a first clock frequency;

means for generating a second clock signal at a frequency that is a multiple of said first clock frequency;

means for generating from said first data sequence an intermediate oversampled data sequence at the frequency of said second clock signal; and means for decimation of said intermediate oversampled data sequence to produce said second longer sequence of data elements for display on said graphics display panel, said decimation means comprising means for selectively passing or discarding data elements from said intermediate oversampled data sequence according to Bresenham's line algorithm, thereby generating said second longer sequence.

2. The apparatus of claim 1 wherein said clock signal generator means comprises a frequency divider wherein said first clock frequency is derived from said second clock frequency by division by an integer in said frequency divider.

3. The apparatus of claim 1 wherein said oversampling means comprises a sampling register clocked at said second clock frequency, the inputs of said sampling register receiving the data outputs from said input register.

4. The apparatus of claim 1 wherein said means for passing or discarding data elements comprises means for generating an output clock by selectively deleting clock pulses from said clock signal generator means, and means for combining said output clock with said intermediate oversampled data sequence.

5. The apparatus of claim 1 wherein said second clock frequency is twice said first clock frequency.

6. The apparatus of claim 1 wherein said decimator means operates linearly with time so as to selectively delete clock pulses from said clock signal generator means at approximately equal intervals of time.

7. The apparatus of claim 1 further comprising a digital low pass filter coupled between the output of said oversampling means and the input of said decimator.

8. Apparatus according to claim 7 wherein said digital low pass filter comprises:

a delay register clocked by said second clock for receiving said intermediate oversampled data sequence and delaying it by one clock period; and an averaging adder for adding each element of said delayed oversampled data sequence and the contemporaneous data element from said intermediate oversampled data sequence and halving the result;

said averaging adder being operative to provide an interpolated oversampled data sequence, said interpolated oversampled data sequence being applied as the input to said decimator means instead of said intermediate oversampled data sequence.

9. The apparatus of claim 8 wherein said delay register comprises a single flip-flop.

10. The apparatus of claim 1 in which each said data element comprises one bit of data.

11. Apparatus for horizontal expansion of a first sequence of data elements to a second sequence of data elements for display on a display panel of different horizontal resolution than that of said first data sequence, the apparatus comprising:

an input register for receiving said first data sequence at a first clock frequency;

means for generating a second clock signal at a frequency that is a multiple of said first clock frequency;

means for generating from said first data sequence an intermediate oversampled data sequence at the frequency of said second clock signal;

binary horizontal expansion patterns of a specified bit length, one of said patterns corresponding to a group of data values of said intermediate oversampled data sequence of said specified bit lengths said group representing one row of a character cell wherein said character cell is represented by a finite number of rows;

means for generating an output clock by combining said corresponding expansion pattern with said second clock signal, wherein each zero bit of said corresponding expansion pattern represents a deletion of one clock pulse from said second clock signals and each one bit of said corresponding expansion pattern represents inclusion of a clock pulse from said second clock signal; and means for generating said second sequence by combining said intermediate oversampled data sequence with said output clock.

12. The apparatus of claim 11 wherein said output clock operates nonlinearly with respect to time, to provide improved image quality and legibility for each character cell received.

13. The apparatus of claim 11 wherein said horizontal expansion pattern is eight bits wide.

14. A computer system including a central processing unit, a system memory and a graphics controller for horizontal expansion of a first sequence of data elements representing pixels of graphics display lines to a second longer sequence of data elements, for display at a higher horizontal resolution than that of said first data sequence, the system comprising:

a bus controller for coupling said central processing unit and said system memory to said graphics controller, and a graphics display panel coupled to said graphics controller for display of said second data sequence at a higher resolution than that of said first data sequence;

said graphics controller comprising an input register for receiving said first data sequence at a first clock frequency; a frequency divider for generating a second clock signal at a frequency that is a multiple of said first clock frequency; a flip-flop for generating from said first data sequence an intermediate oversampled data sequence at the frequency of said second clock signal; and circuitry for decimation of said intermediate oversampled data sequence to produce said second longer sequence of data elements;

said decimator circuitry comprising: a plurality of binary horizontal expansion patterns corresponding to groups of data values of said intermediate oversampled data sequence wherein each zero bit of said corresponding expansion pattern represents a deletion of one clock pulse from said second clock signal; means for generating an output clock by combining said horizontal expansion patterns with said second clock; and means for combining said output clock with said intermediate oversampled data sequence to generate said second sequence.

15. The apparatus of claim 14 wherein said means for generating an output clock comprises means for selectively deleting clock pulses from said second clock.

16. A method for linear horizontal expansion of a first sequence of data elements to a second sequence of data elements longer than said first data sequence, the method comprising:

oversampling said first data sequence at a multiple of the frequency thereof to produce an intermediate oversampled data sequence; and linearly decimating said intermediate oversampled data sequence by a factor of less than unity to produce said second sequence of data elements, in accordance with Bresenham's line algorithm.

17. The method of claim 16 wherein said intermediate oversampled data sequence is at twice the frequency of said first sequence of data elements.

18. The method of claim 16 further comprising filtering said intermediate oversampled data sequence to provide an interpolated oversampled data sequence, said interpolated oversampled data sequence being decimated instead of said intermediate oversampled data sequence.

19. A method for nonlinear horizontal expansion of a first sequence of data elements representing successive rows of successive character cells corresponding to a sequence of text characters to a second sequence of data elements longer than said first sequence, the method comprising:

oversampling said first data sequence at a specified multiple of the frequency thereof to produce an intermediate oversampled data sequence;

forming a horizontal expansion pattern corresponding to each said text character, said pattern set to a specified length equal to the number of data elements in each row of said character cells; and decimating each said specified multiple of data elements by deleting one element whenever the corresponding bit of said horizontal expansion pattern is zero, to provide said second sequence of data elements.

20. The method of claim 19 wherein said specified multiple is two.

21. The method of claim 19 wherein said specified length of said horizontal expansion pattern is eight bits.

* * * * *